US009514617B2

(12) United States Patent
Moon

(10) Patent No.: US 9,514,617 B2
(45) Date of Patent: Dec. 6, 2016

(54) MEDIUM SEPARATING AND STACKING APPARATUS, MEDIUM STORAGE BOX, AND FINANCIAL DEVICE

(71) Applicant: LG CNS CO., LTD., Seoul (KR)

(72) Inventor: Changho Moon, Seoul (KR)

(73) Assignee: LG CNS CO., LTD., Seoul (KR)

( * ) Notice: Subject to any disclaimer, the term of this patent is extended or adjusted under 35 U.S.C. 154(b) by 0 days.

(21) Appl. No.: 14/748,972

(22) Filed: Jun. 24, 2015

(65) Prior Publication Data

US 2015/0371507 A1 Dec. 24, 2015

(30) Foreign Application Priority Data

Jun. 24, 2014 (KR) ..... 10-2014-0077232

(51) Int. Cl.

| | |
|---|---|
| ***B65H 29/38*** | (2006.01) |
| ***B65H 29/40*** | (2006.01) |
| ***B65H 5/06*** | (2006.01) |
| ***G07F 19/00*** | (2006.01) |
| ***B65H 3/52*** | (2006.01) |
| ***G07D 11/00*** | (2006.01) |
| ***B65H 83/02*** | (2006.01) |

(52) U.S. Cl.

CPC ..... *G07F 19/201* (2013.01); *B65H 3/5215* (2013.01); *B65H 5/062* (2013.01); *B65H 29/38* (2013.01); *B65H 83/025* (2013.01); *G07D 11/0021* (2013.01); *B65H 2403/725* (2013.01); *B65H 2404/1114* (2013.01); *B65H 2404/1321* (2013.01); *B65H 2404/16* (2013.01); *B65H 2404/191* (2013.01); *B65H 2701/1912* (2013.01)

(58) Field of Classification Search

CPC ..... B65H 2701/1912; B65H 2404/114; B65H 29/40; B65H 83/025; B65H 5/06; B65H 29/38; G07D 11/0018; G07D 11/0012;G07F 19/201; G07F 19/202; G07F 19/203; G07F 19/205

See application file for complete search history.

(56) References Cited

U.S. PATENT DOCUMENTS

| | | | | |
|---|---|---|---|---|
| 4,678,175 A * | 7/1987 | Arldt | B65H 1/08 | 271/154 |
| 7,243,914 B2 * | 7/2007 | Tokunaga | B65H 3/06 | 271/3.01 |
| 7,492,401 B2 * | 2/2009 | Lim | H03F 3/005 | 348/241 |
| 8,152,158 B2 * | 4/2012 | Hsu | B65H 3/0684 | 271/117 |
| 8,459,633 B2 * | 6/2013 | Lee | B65H 3/0653 | 271/10.04 |

FOREIGN PATENT DOCUMENTS

| | | | |
|---|---|---|---|
| JP | 07160930 A | * | 6/1995 |
| JP | 2011068115 A | | 4/2011 |
| KR | 2020090003905 A | | 4/2009 |
| KR | 1020110134965 A | | 12/2011 |
| KR | 20120128980 A | | 11/2012 |

OTHER PUBLICATIONS

Office Action dated Mar. 30, 2016 in Korean Application No. 10-2014-0077232.

* cited by examiner

*Primary Examiner* — Luis A Gonzalez
(74) *Attorney, Agent, or Firm* — Saliwanchik, Lloyd & Eisenschenk

(57) ABSTRACT

A medium separating and stacking device is provided. In one embodiment, a medium separating and stacking device comprises a frame, a first shaft rotatably coupled to the frame, a second shaft rotatably coupled to the frame and spaced apart from the first shaft, and a rotation prevention part allowing the second shaft to stop at a set position by using a magnetic force.

14 Claims, 6 Drawing Sheets

MEDIUM SEPARATING AND STACKING APPARATUS, MEDIUM STORAGE BOX, AND FINANCIAL DEVICE

CROSS-REFERENCE TO RELATED APPLICATIONS

This application claims the benefit under 35 U.S.C. §119 of Korean Patent Application No. 10-2014-0077232, filed Jun. 24, 2014, which is hereby incorporated by reference in its entirety.

BACKGROUND

In general, financial devices are devices for processing financial business desired by customers comprising depositing/withdrawing media such as bills and checks. For example, the bills, the checks, and the like may be called "media."

The financial devices may comprise modules each of which performs the deposit, withdrawal, determination, stacking of media, and each of the modules may be connected to each other by a plurality of transfer paths. The media passes through the transfer paths and are transferred to each of the modules.

Here, the modules to which the media is stacked may comprise a medium separating and stacking device separating or stacking media.

Also, a stack roller constituting the medium separating and stacking device comprises a plurality of stack sheets on an outer circumferential surface thereof. When a medium is stacked in a medium storage part, the stack sheet hits one surface of the medium to stack the medium in the storage part, and, when a medium is separated from the medium storage part, the stack sheet is avoided from the transfer path so as not to interfere with the medium.

That is, since the stack sheet is provided only a portion of the outer circumferential surface of the stack roller instead of all the outer circumferential surface of the stack roller, the stack sheet is inserted into the transfer path to hit the medium during the stacking of the medium and avoided from the medium transfer path during the separation of the medium.

However, since a recovery means for avoiding the stack sheet from the medium transfer path disclosed in Korean Patent Publication No. 2010-0054706 and Korean Patent Publication No. 2010-0069069 is formed of an elastic material such as a spring, an elastic force may decrease due to repeated usage. Thus, it is difficult that the stack sheet may be avoided to an exact position. Also, the recovery means does not properly perform the contraction and relaxation operation of the spring when foreign substances are accumulated between the installed spring to thereby cause malfunction frequently.

As disclosed in Korean Patent Publication No. 2012-0128980, a method for avoiding the stack sheet by using an elastic force of the stack sheet and a stopper fixing the stack sheet may generate noise and reduce the elastic force of the stack sheet when the stack sheet is frequently used

BRIEF SUMMARY

Embodiments provide a medium separating and stacking device, a medium storage box, and a financial device.

In one embodiment, a medium separating and stacking device comprises: a frame; a first shaft rotatably coupled to the frame; a second shaft rotatably coupled to the frame and spaced apart from the first shaft; and a rotation prevention part allowing the second shaft to stop at a set position by using a magnetic force.

In another embodiment, a medium storage box comprises: a medium storage part for storing a medium; and a medium separating and stacking device separating the medium stored in the medium storage part or stacking the medium into the medium storage part, wherein the medium separating and stacking device stops a sheet roller at a position at which a sheet of the sheet roller is avoided from a transfer path of the medium by using a magnetic force when the medium is separated.

In further another embodiment, a financial device comprises: a customer information acquisition part for acquiring customer information; a user interface for displaying a menu and information for depositing or withdrawing a medium or for inputting or selecting a command or information for depositing or withdrawing a medium; and a medium storage box storing a medium to be deposited or withdrawn, wherein the medium storage box stops a sheet roller at a position at which a sheet of a sheet roller is avoided from a transfer path of the medium by using a magnetic force when the medium is separated for withdrawing.

DETAILED DESCRIPTION OF THE EMBODIMENTS

Figure 1:
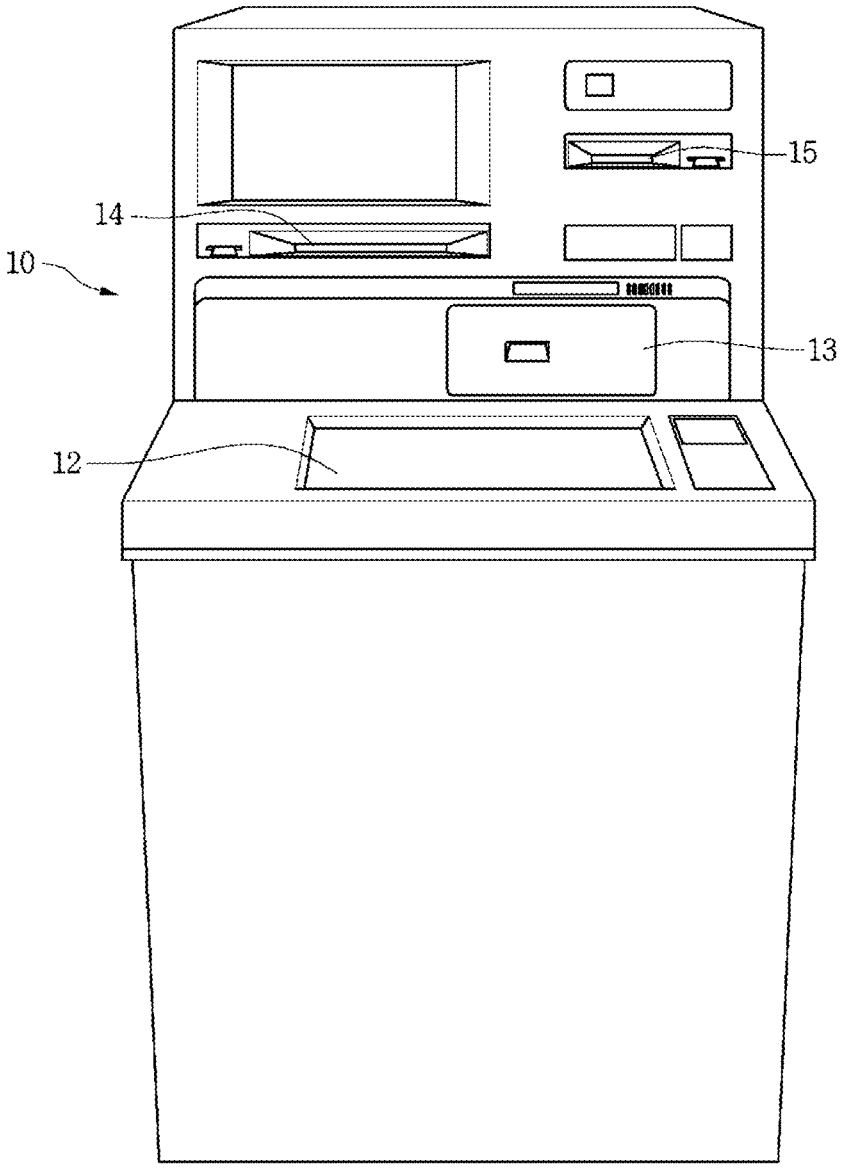
FIG. 1 is a perspective view of a financial device according to an embodiment.

Hereinafter, exemplary embodiments of the present disclosure will be described with reference to the accompanying drawings. Regarding the reference numerals assigned to the elements in the drawings, it should be noted that the same elements will be designated by the same reference numerals, wherever possible, even though they are shown in different drawings. Also, in the description of embodiments, detailed description of well-known related structures or functions will be omitted when it is deemed that such description will cause ambiguous interpretation of the present disclosure.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

A financial device according to embodiments is a device that performs financial businesses, i.e., medium processing comprising processing such as deposit processing, giro receipt, or gift certificate exchange and/or processing such as withdrawal processing, giro dispensing, or gift certificate dispensing by receiving various media such as, e.g., paper moneys, bills, giros, coins, gift certificates, etc. For example, the financial device may comprise an automatic teller machine (ATM) such as a cash dispenser (CD) or a cash recycling device. However, the financial device is not limited to the above-described examples. For example, the financial device may be a device for automatically performing the financial businesses such as a financial information system (FIS).

Hereinafter, assuming that the financial device is the ATM, an embodiment will be described. However, this assumption is merely for convenience of description, and technical idea of the present disclosure is not limited to the ATM.

Figure 2:
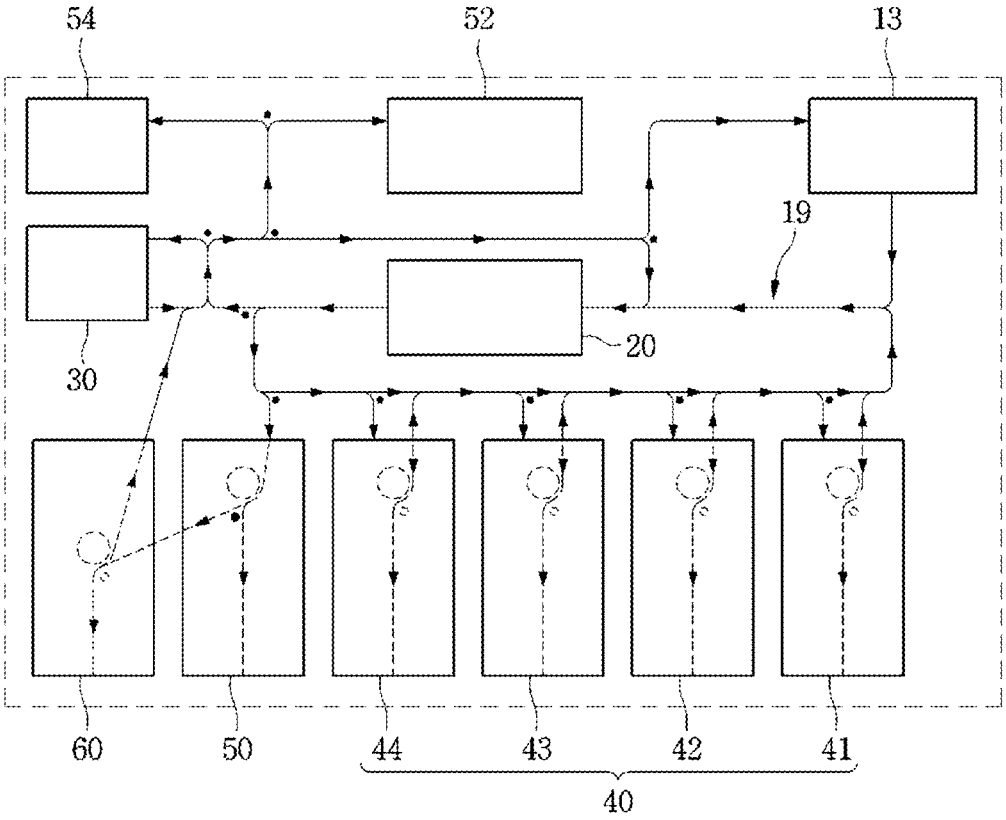
FIG. 2 is a configuration view of the financial device in FIG. 1.

FIG. 1 is a perspective view of a financial device according to an embodiment, and FIG. 2 is a configuration view of the financial device in FIG. 1.

Referring to FIGS. 1 and 2, a financial device 1 according to an embodiment comprises a main body 10 in which a plurality of components are built. The main body 10 may comprise a medium entrance part 13 for depositing/withdrawing a medium such as a bill or check.

The medium entrance part 13 may comprises a medium accommodation space that is accessible by a customer. The medium accommodation space may be opened or closed by a covering member such as a shutter and/or a cover and sometimes maintain an open state without closing.

Also, the financial device 1 may further comprise a bankbook entrance part 14 for accepting or dispensing a bankbook and a card entrance part 15 for accepting or dispensing a card. In the current embodiment, the bankbook entrance part 14 or the card entrance part 15 may be called a customer information acquisition part for acquiring customer's information. The present disclosure is not limited to a kind of customer information acquisition part. For example, the customer information acquisition part may acquire information recorded in an RFID tag or USB or acquire customer's information by using biological information such as customer's fingerprint.

Also, the financial device 1 may further comprise a user interface part 12 for displaying a menu and information for depositing or withdrawing a medium or for inputting or selecting a command or information for depositing or withdrawing a medium.

The financial device 1 may further comprise a transfer path 19 guiding a medium. The transfer path 19 may connect each of modules to each other disposed in the financial device 1.

The financial device 1 may further comprise a discrimination part 20. The discrimination part 20 may distinguish a kind of medium or determine a faulty medium when the medium is accepted or dispensed.

The financial device 1 may further comprise a bill temporary stacking part 30 in which a bill is temporarily stacked. The bill temporary stacking part 30 may temporarily store a bill accepted through the medium entrance part 13 when the customer intends to deposit the bill in the financial device 1. The bill stacked in the bill temporary stacking part may be transferred to bill storage boxes 41, 42, and 43 when bill acceptance is finally decided by the customer.

The financial device 1 may further comprise a medium storage box 40 for storing a medium. The medium storage box 40 may comprise at least one bill storage boxes 41, 42, and 43 and at least one check storage box 44. This specification is not limited to the number of bill storage boxes 41, 42, and 43 and check storage box 44.

The medium storage box 40 may comprise a medium storage part 150 having a medium inlet to which a transferred medium is accepted and a medium outlet from which an stacked medium is separated and dispensed, and a medium separating and stacking device (see reference numeral 100 in FIG. 3) separating the medium stacked in the medium storage part 150 or stacking the medium in the medium storage part 150.

The financial device 1 may further comprise a check deposit box 54. A check that is normally deposited may be stored in the check deposit box 54. The check deposit box 54 and the check storage box 44 may be separated separate modules. Alternatively, the check deposit box 54 and the check storage box 44 may be disposed in a single storage box. The single storage box may have an inner space partitioned into a space for storing a check to be deposited and a space for storing a check to be dispensed.

The financial device 1 may further comprise a first recovery box 50 for storing a bill or check that is determined as faulty in the deposit process and a second recovery box 52 for storing a bill or check that is determined as faulty in the withdrawal process, and a recovery supplement box 60. Each of the first recovery box 50 and the second recovery box 52 may be provided in plurality and used as a check recovery box or a bill recovery box.

The recovery supplement box 60 may supplement a bill or check into the bill storage boxes 41, 42, and 43 or the check storage box 44 or recover a bill or check from the bill storage boxes 41, 42, and 43 or the check storage box 44. Also, the financial device 1 may further comprise a third recovery box 54 for recovering a non-accepted medium when the customer does not accept the medium that is dispensed from the medium entrance part 13 to withdraw.

In the financial device 1 of an embodiment, the recovery boxes 50 and 52 and the recovery supplement box 60 may be removed. Also, the number of the recovery boxes 50 and 52 and the recovery supplement box 60 is not limited.

Figure 3:
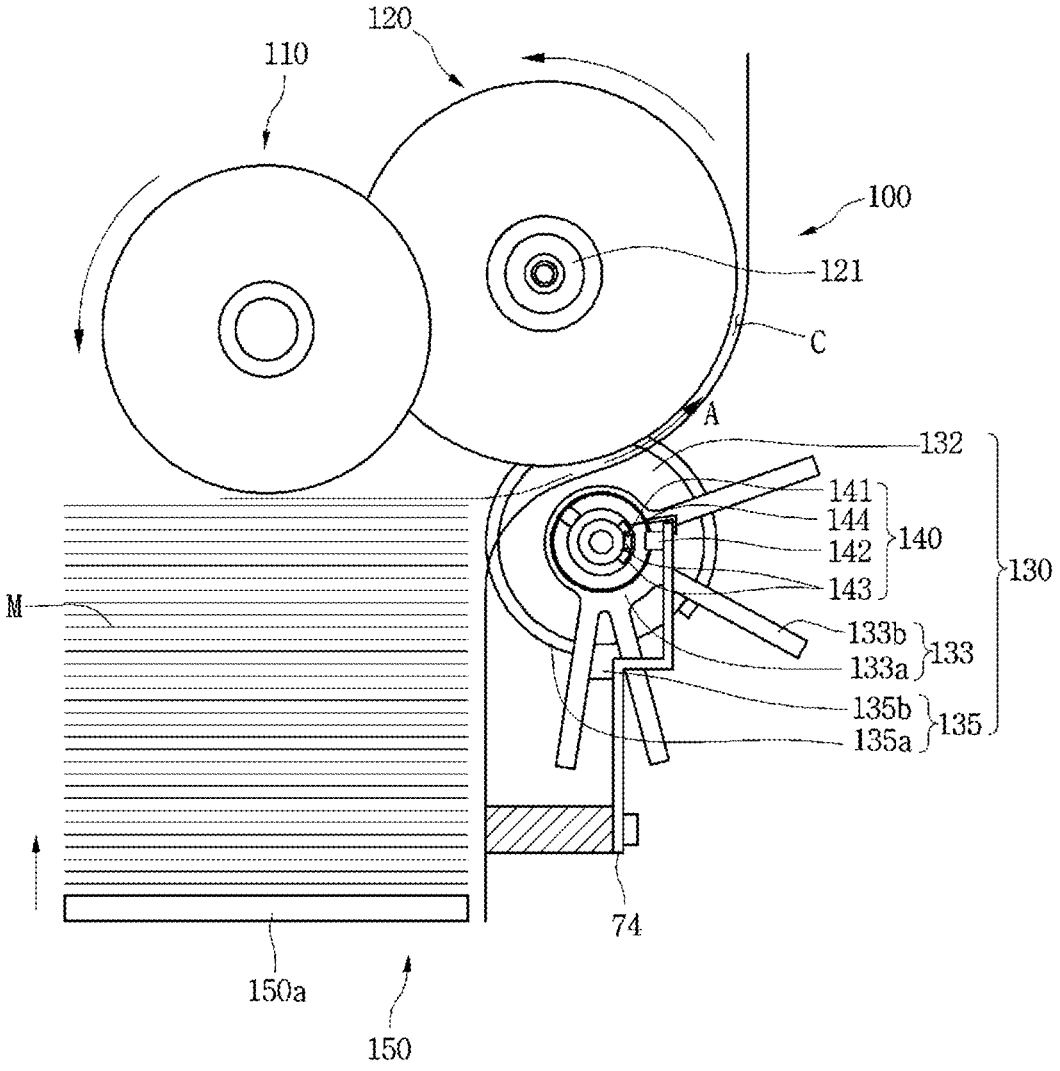
FIG. 3 is a view illustrating an operation of a medium separating and stacking device while a medium is separated.
Figure 4:
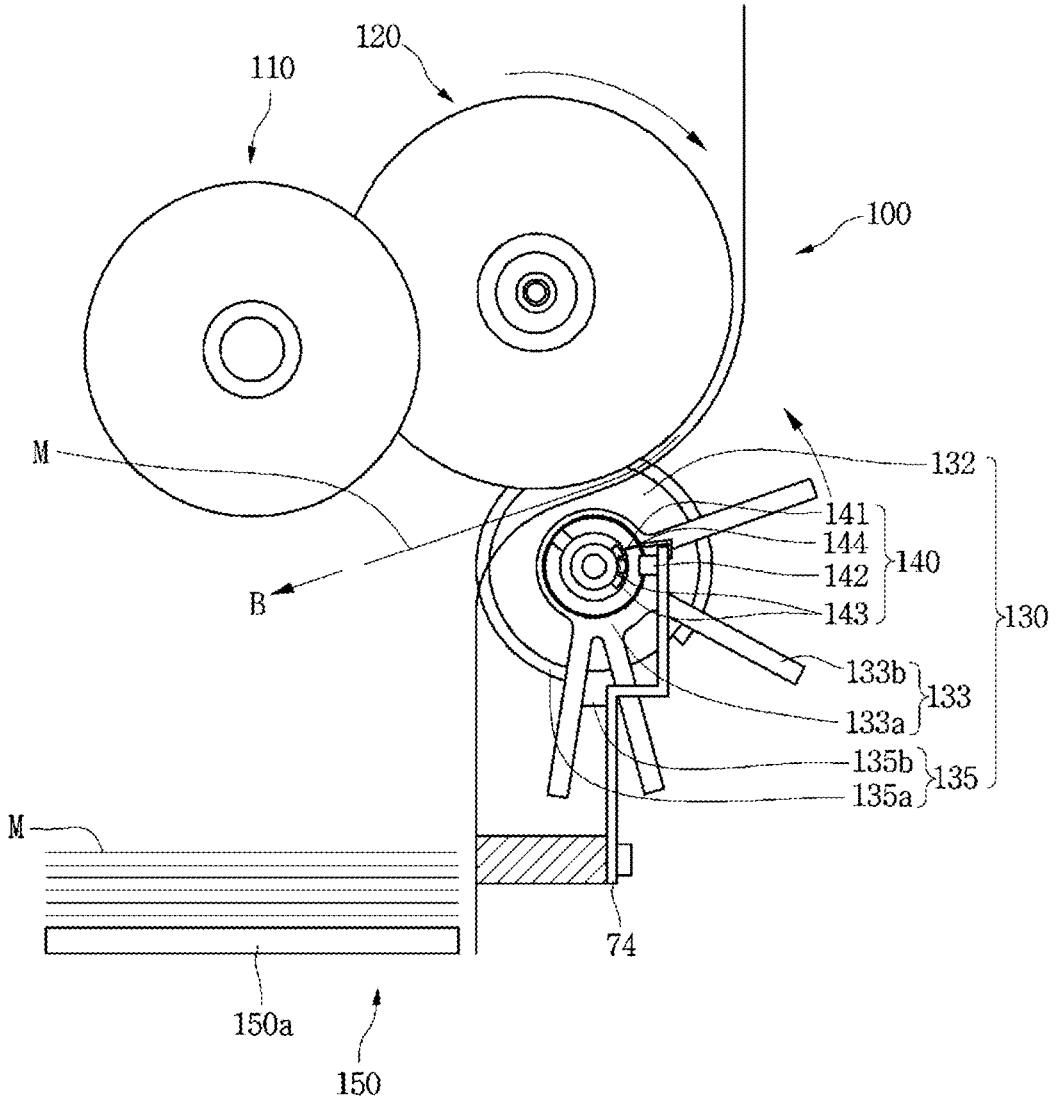
FIG. 4 is a view illustrating an operation of a medium separating and stacking device while a medium is stacked.
Figure 5:
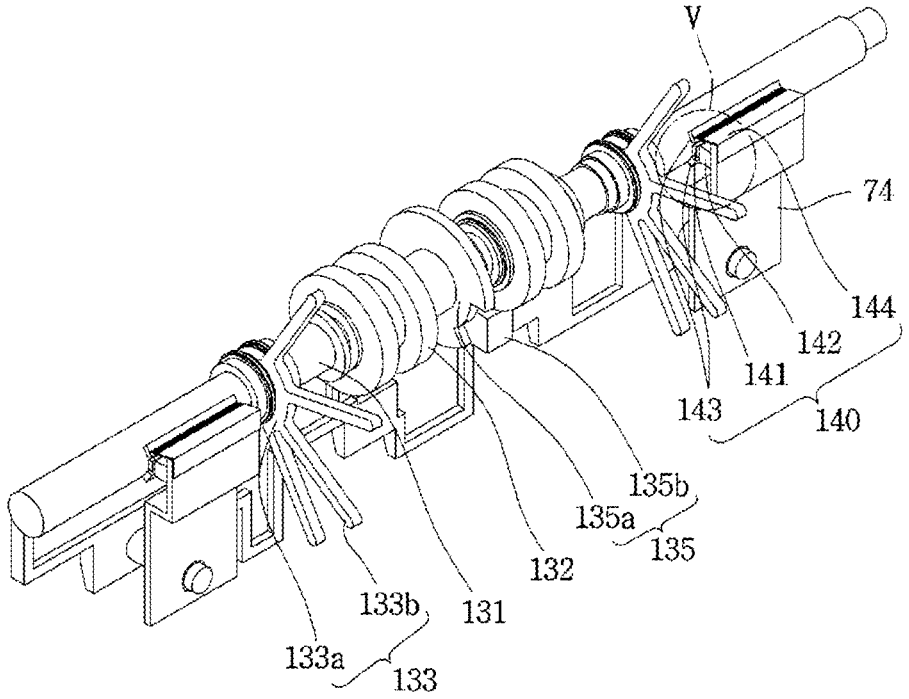
FIG. 5 is a perspective view illustrating a gate roller unit of the medium separating and stacking device in FIG. 4.
Figure 6:
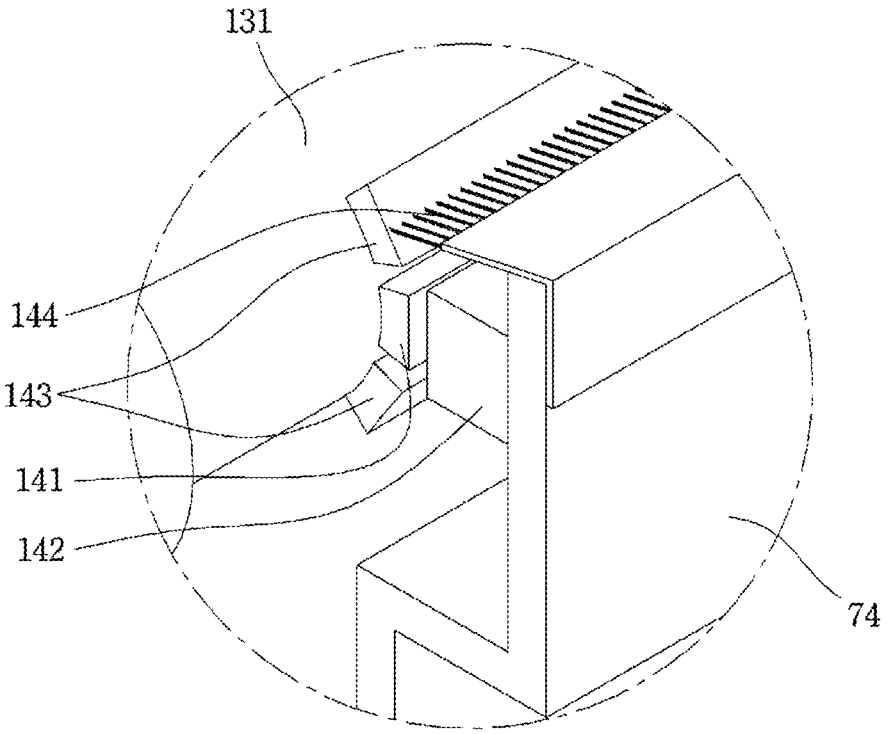
FIG. 6 is an enlarged perspective view of a V in FIG. 5.

FIG. 3 is a view illustrating an operation of a medium separating and stacking device while a medium is separated, and FIG. 4 is a view illustrating an operation of a medium separating and stacking device while a medium is stacked. FIG. 5 is a perspective view of a gate roller unit of the medium separating and stacking device in FIG. 4, and FIG. 6 is an enlarged perspective view of V in FIG. 5.

Referring to FIGS. 3 to 6, the medium storage box 40 may comprise a medium storage part 150 for storing a medium M and a medium separating and stacking device 100 for separating the medium M stacked in the medium storage part 150 or stacking the medium M into the medium storage part 150.

The medium separating and stacking device 100 may be disposed adjacent to the medium storage part 150 and separate the medium M stacked in the medium storage part 150 or transfer and stack the medium M into the medium storage part 150. The medium separating and stacking device 100 may comprise a pickup roller 110, a feed roller 120, and a gate roller unit 130.

The pickup roller 110 is disposed on an outlet side of the medium storage part 150, through which the medium M is dispensed, to pick up the medium M stacked in the medium storage part 150.

The feed roller 120 is coupled to a feed roller shaft 121 and disposed adjacent to the pickup roller 110. The feed roller 120 transfers the medium M through a transfer path C in a direction B in which the medium is stacked in the medium storage part 150 or in a direction A (separation direction) opposite to the direction B. Also, the feed roller shaft 121 may be disposed on a frame (now shown) of the financial device 1.

The gate roller unit 130 may comprise a gate roller shaft 131 disposed on the frame (now shown). The gate roller unit 130 may be disposed adjacent to the feed roller 120 and transfer the medium on the transfer path C.

Also, the feed roller shaft 121 and the gate roller shaft 131 may be disposed in parallel on the frame (now shown).

The gate roller unit 130 may hit one surface of the medium M to stably stack the medium M in the medium storage part 150 or generate friction with the medium M when the medium M is separated from the medium storage part 150, so that the picked-up medium M is separated one by one by the feed roller 120 and the gate roller 132 and transferred.

Also, the pickup roller 110, the feed roller 120, and the gate roller unit 130 may receive power from a power source (now shown) to rotate.

Here, the pickup roller 110 may receive a rotational force of the feed roller 120 to rotate or rotate by a power source different with the power source of the feed roller 120.

The medium storage part 150 may comprise a supporting plate 150*a* on which the medium M is stacked. The supporting plate 150*a* compresses the medium M toward the pick-up roller when the medium M is separated by the pickup roller 110.

The gate roller unit 130 may comprise a gate roller shaft 131, a gate roller 132, a sheet roller 133, and a rotation prevention part 140.

The gate roller shaft 131 may be connected to a shaft of the feed roller 120 by, e.g., a gear. The gate roller shaft 131 may be connected to the gear as a one-way bearing (not shown). The one-way bearing (not shown) transmits a rotational force to the gate roller shaft 131 when the feed roller 120 rotates in one direction for an stacking of the medium M and does not deliver the rotational force to the gate roller shaft 131 when the feed roller 120 rotates in the other direction for a separation of the medium M.

The gate roller 132 is coupled to the gate roller shaft 131. When the feed roller 120 rotates in one direction (a clockwise direction in the drawings), the gate roller 132 rotates counter-clockwise to transfer the medium M to the medium storage part 150.

When the medium M is separated from the medium storage part 150, the gate roller 132 becomes to a stop state. Since the stopped gate roller 132 generates friction with the medium M, the picked-up media M may be separated one by one by the feed roller 120 and the gate roller 32.

The sheet roller 133 may be disposed adjacent to the gate roller 132 and coupled to the gate roller shaft 131. When the medium M is transferred to the medium storage part 150, the sheet roller 133 may hit one surface of the medium M to stably stack the medium M on the supporting plate 150*a*.

The sheet roller 133 may comprise a sheet roller body 133*a* coupled to the gate roller shaft 131 and the plurality of sheets 133*b*.

When the medium M is separated from the medium storage part 150, the plurality of sheets 133*b* may be avoided from the transfer path C in order not to interfere with the medium M with each other. Accordingly, the plurality of sheets 133*b* may be spaced from each other within a range of a predetermined angle on one side of an outer circumferential surface of the main body 133*a* of the sheet roller.

The rotation prevention part 140 may stop the sheet roller shaft and maintain a stopped position so that the plurality of sheets 133*b* are located in a predetermined position.

In more detail, the rotation prevention part 140 may fix the gate roller shaft 131 by a magnetic force in a position in which the plurality of sheets 133*b* are avoided from the transfer path C of the medium M so that the plurality of sheets 133*b* and the medium M are not interfered with each other when the medium M is separated from the medium storage part 150.

The rotation prevention part 140 may comprise a first magnetic body and a second magnetic body 142.

The first magnetic body 141 may be fixedly connected to one side of the gate roller shaft 131, and the second magnetic body 142 may be spaced from the first magnetic body 141 and disposed on a bracket 74 that is one component of the frame (not shown) on which the medium storage part 150 is positioned.

The second magnetic body 142 may be fixed to the bracket 74 to face the first magnetic body 141. The gate roller shaft 131 may be a non-magnetic body so that a magnetic force formed between the first and second magnetic bodies 141 and 142 are not affected. Here, the first magnetic body 141 and the second magnetic body 142 may be permanent magnets having polarities opposite to each other.

The rotation prevention part 140 may further comprise a plurality of third magnetic bodies 143. The plurality of third magnetic bodies 143 may be permanent magnets.

The first magnetic body 141 may be disposed between the plurality of third magnetic bodies 143. That is, the plurality of third magnetic bodies 143 may be disposed on the gate roller shaft 131.

For example, two third magnetic bodies 143 may be disposed on the gate roller shaft 131, and the first magnetic body may be disposed between the two third magnetic bodies 143.

The plurality of third magnetic bodies 143 and the first magnetic body 141 may be spaced from each other in a rotation direction of the gate roller shaft 131. The plurality of third magnetic bodies 143 may have the same polarity as that of the second magnetic body 142. Accordingly, the plurality of third magnetic bodies 143 may have a polarity opposite to that of the first magnetic body 141.

Since a repulsive force is generated between the plurality of third magnetic bodies 143 and the second magnetic body 142 and an attractive force is generated between the first magnetic body 141 and the second magnetic body 142, the rotation prevention part 140 may firmly fix the stopped gate roller shaft 131.

The medium separating and stacking device 100 may further comprise a brush 144.

The brush 144 may be disposed on the bracket 74 that is one component of the frame (not shown) and remove foreign substances attached on surfaces of the first magnetic body 141 and the plurality of third magnetic bodies 143 when the gate roller shaft 131 rotates.

A surface of the medium may be coated with a metal material for identification of authenticity or prevention of forgery. The metal material applied to the medium M may be separated from the medium M during a transfer process of the medium M. The separated metal material may be attached to the first magnetic body 141, the second magnetic body 142, and the plurality of third magnetic bodies 143 and affect to the magnetic force, to cause a malfunction of the financial device 1.

The brush 144 removes the metal material attached to the first magnetic body 141 and the plurality of third magnetic body 143. Similarly, when the brush 144 is attached to the gate roller shaft 131, foreign substances attached to the second magnetic body 142 may be removed. Here, the plurality of sheets 133*b* may be in a state in which the plurality of sheets 133*b* are avoided from the transfer path C to the brush 144. For example, the brush 144 may be disposed adjacent to the first magnetic body 141 on the gate roller shaft 133.

The gate roller unit 130 may further comprise a position detecting sensor 135 for detecting a rotational angle of the sheet roller 133 to transmit a power blocking signal to the power source (not shown) in order to stop a rotation of the sheet roller 133 by the rotation prevention part 140 at a predetermined position The position detecting sensor 135 may comprise a position detecting wheel 135*a* and an interrupt sensor 135*b*.

The position detecting wheel 135*a* is fixedly coupled to the gate roller shaft 131 and has a hole defined in one side thereof. Accordingly, when light emitted from the light emitting part of the interrupt sensor 135*b* passes through the hole and is not detected by the light receiving part, the control part (not shown) stops the power source (not shown). Then, the gate roller shaft 131 may be stopped.

Hereinafter, referring to FIGS. 3 and 4, a process of stacking the medium M in the medium storage part 150 or separating the medium M stacked in the medium M will be described in detail.

Referring to FIG. 3 first, the pickup roller 110 and the feed roller 120 rotate counter-clockwise in the drawings to separate the medium M from the medium storage part 150, and the supporting plate 150*a* compresses the medium M toward the pickup roller. The gate roller unit 130 may be in a stop state in a position in which the plurality of sheets 133*b* are avoided from the transfer path C of the medium M. Here, the gate roller shaft 131 is stopped, and the second magnetic body 142 and the first magnetic body 141 face each other.

Then, the medium M disposed at the uppermost side among the medium M is transferred in an arrow A direction by the pickup roller 110 and the feed roller 120 and passes between the feed roller 120 and the gate roller 132. Here, since the gate roller 132 is stopped to generate a friction force between the medium M and the gate roller 132, the picked-up medium M may be separated one by one even when the pickup roller 110 picks up at least two media. As described above, an attractive force acts between the second magnetic body 142 and the first magnetic body 141 while the second magnetic body 142 and the first magnetic body 141 face each other. Thus, the gate roller shaft 131 may maintain a stop state in a separation process of the medium.

Also, since a repulsive force acts between the plurality of third magnetic body 143 and the second magnetic body 142, the gate roller shaft 131 may be further firmly fixed in the stopped location.

Next, referring to FIG. 4, the feed roller 120 rotates clockwise in the drawings to stack the medium M, and the gate roller 132 rotates counter-clockwise in the drawings. Then, the medium M passes between the feed roller 120 and the gate roller 132 in an arrow B direction and is transferred toward the medium storage part 150.

When the medium M is inserted into the medium storage part 150, one sheet of the plurality of sheets 133*b* disposed on the sheet roller 133 may hit a top surface of the medium M inserted into the medium storage part 150, and the medium M hit by the one sheet of the plurality of sheets 133*b* is stacked on the supporting plate 150*a* of the medium storage part 150.

Hereinafter, a principle in which the gate roller shaft 131 is stopped in a state in which the plurality of sheets 133*b* are avoided from the transfer path C will be described in detail.

First, when the medium M is transferred to the medium storage part 150, the plurality of sheets 133*b* hit one surface of the medium M to stack the medium M toward the supporting plate 150*a* of the medium storage part 150.

When the medium M is completely stacked on the medium storage part 150, the light emitting part of the interrupt sensor 135*b* emits light so that the position detecting sensor 135 determines a time for blocking power of the power source (not shown). When the light receiving part of the interrupt sensor 135*b* does not detect light emitted from the light emitting part of the interrupt sensor 135*b*, the control part (now shown) allows the power source (not shown) to stop. When the light receiving part of the interrupt sensor 135*b* detects the light emitted from the light emitting part of the interrupt sensor 135*b*, the control part (now shown) may also allow the power source (not shown) to stop.

Since the gate roller shaft 131 is connected to a one-way bearing, the gate roller shaft 131 may temporarily rotate even when power transmitted from the power source (now shown) is blocked.

However, according to an embodiment, although the gate roller shaft 131 temporarily rotates, the gate roller shaft 131 may be stopped by the attractive force acting between the first magnetic body 141 and the second magnetic body 142.

Here, since the repulsive force acts between the plurality of third magnetic body 143 and the second magnetic body 142, which are disposed on the rotation prevention part 140, the gate roller shaft 131 may be further firmly fixed in a stopped position.

That is, the plurality of third magnetic bodies 143 may further firmly fix the gate roller shaft 131 in the stopped position, to thereby prevent the gate roller 132 from rotating clockwise in the drawings by friction with the medium M transferred in the arrow A direction.

When the gate roller 132 rotates, the sheet roller 133 may rotate, and thus the plurality of sheets 133*b* may be interfered with the medium M that is being transferred. Here, the plurality of third magnetic bodies 143 may further firmly fix the gate roller shaft 131 to prevent the gate roller 132 from rotating, thereby, as a result, preventing interference phenomenon between the plurality of sheets 133*b* and the medium M.

In the above-described embodiment, the feed roller shaft may be called a first shaft, and the gate roller shaft may be called a second shaft.

Even though all the elements of the embodiments are coupled into one or operated in the combined state, the present disclosure is not limited to such an embodiment. That is, all the elements may be selectively combined with each other without departing the scope of the invention. Furthermore, when it is described that one comprises (or includes or has) some elements, it should be understood that it may comprise (or include or has) only those elements, or it may comprise (or include or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the spirit and scope of the invention as defined by the appended claims. Therefore, the preferred embodiments should be considered in descriptive sense only and not for purposes of limitation, and also the technical scope of the invention is not limited to the embodiments. Furthermore, is defined not by the detailed description of the invention but by the appended claims, and all differences within the scope will be construed as being comprised in the present disclosure.

What is claimed is:

1. A medium separating and stacking device, comprising:
a first shaft;
a second shaft spaced apart from the first shaft; and
a rotation prevention part allowing the second shaft to stop at a set position by a magnetic force;
wherein the rotation prevention part comprises:
a first magnetic body disposed on the second shaft, and
a second magnetic body disposed on a bracket and spaced apart from the second shaft.

2. The medium separating and stacking device of claim 1, further comprising a sheet roller that comprises a plurality of bars and is disposed on the second shaft, and wherein the set position is a position at which the plurality of bars avoids running into a transfer path of the medium in a separation process.

3. The medium separating and stacking device of claim 1, wherein the first magnetic body and the second magnetic body have polarities opposite to each other.

4. The medium separating and stacking device of claim 1, wherein the second shaft is a non-magnetic body.

5. The medium separating and stacking device of claim 1, further comprising at least one third magnetic body coupled to the second shaft, disposed adjacent to the first magnetic body, and having a polarity opposite to that of the first magnetic body.

6. The medium separating and stacking device of claim 5, wherein a plurality of third magnetic bodies are disposed on the second shaft, and the first magnetic body is disposed between the plurality of third magnetic bodies in a circumferential direction.

7. The medium separating and stacking device of claim 1, wherein each of the first magnetic body and the second magnetic body comprises a permanent magnet.

8. The medium separating and stacking device of claim 1, further comprising a brush coupled to the bracket to remove foreign substances attached to a surface of the first magnetic body.

9. The medium separating and stacking device of claim 1, further comprising a brush coupled to the second shaft to remove foreign substances attached to a surface of the second magnetic body.

10. The medium separating and stacking device of claim 9, wherein the brush is disposed adjacent to the first magnetic body.

11. A medium storage box, comprising:
a medium storage part storing a medium; and
a medium separating and stacking device separating the medium stored in the medium storage part or stacking the medium into the medium storage part,
wherein the medium separating and stacking device stops a sheet roller at a position at which a bar of the sheet roller avoids running into a transfer path of the medium by a magnetic force when the medium is separated;
wherein the medium separating and stacking device comprises:
a first magnetic body disposed on a shaft to which the sheet roller is connected; and
a second magnetic body disposed at a position spaced apart from the shaft and on a bracket.

12. The medium storage box of claim 11, wherein the first magnetic body and the second magnetic body have polarities opposite to each other.

13. The medium storage box of claim 12, further comprising a third magnetic body disposed on the shaft and having polarity opposite to that of the first magnetic body.

14. A financial device, comprising:
a customer information acquisition part acquiring customer information;
a user interface displaying a menu and information for depositing or withdrawing a medium or inputting or selecting a command or information for depositing or withdrawing a medium; and
a medium storage box storing a medium to be deposited or withdrawn,
wherein the medium storage box stops a sheet roller at a position at which a bar of a sheet roller avoids running into a transfer path of the medium by a magnetic force when the medium is separated for withdrawing;
wherein the medium storage box comprises a first magnetic body disposed on a shaft to which the sheet roller is connected; and
a second magnetic body disposed at a position spaced apart from the shaft and on a bracket.

* * * * *